US005570523A

United States Patent [19]

Lin

[11] Patent Number: 5,570,523

[45] Date of Patent: Nov. 5, 1996

[54] ADJUSTABLE CHILD SHOES

[76] Inventor: Ji-Tyan Lin, No. 52-258, Jong Yeong Road, Nan Twen Area, Taichung City, Taiwan

[21] Appl. No.: 455,405

[22] Filed: May 31, 1995

[51] Int. Cl.[6] ..... A43B 3/28; A43B 3/26

[52] U.S. Cl. ..... 36/112; 36/97; 36/100; 36/105

[58] Field of Search ..... 36/97, 100, 101, 36/105, 110, 112

[56] References Cited

U.S. PATENT DOCUMENTS

| | | | |
|---|---|---|---|
| 2,523,449 | 9/1950 | Rosenzweig | 36/97 |
| 3,075,305 | 1/1963 | Shapiro et al. | 36/112 |
| 3,997,985 | 12/1976 | Shiina | 36/97 |
| 4,120,103 | 10/1978 | Colby | 36/97 |

FOREIGN PATENT DOCUMENTS

| | | | |
|---|---|---|---|
| 174665 | 8/1905 | Germany | 36/97 |
| 2340015 | 8/1973 | Germany | 36/112 |

*Primary Examiner*—Marie D. Patterson
*Attorney, Agent, or Firm*—Beveridge, DeGrandi, Weilacher & Young, L.L.P.

[57] ABSTRACT

An adjustable child shoe comprises a heel, a toecap and an insole. The heel has a position guiding groove, an instep, a plurality of positioning protrusions, and a plurality of fastening elements. The toecap has two flaps, an outsole, an adjustable pad, a foldable extending pad and a plurality of positioning holes. A plurality of fastening elements are disposed in the toecap and the heel.

2 Claims, 3 Drawing Sheets

ADJUSTABLE CHILD SHOES

BACKGROUND OF THE INVENTION

The invention relates to a shoe of a child, and more particularly, the invention relates to an adjustable child shoe.

The foot of a child can grow up very fast. Therefore, most new shoes become too small for most children after a period of wear. The sole of a child grows very fast, so shoes will become too small a few months later. Most shoes are made in one piece, they cannot be adjusted at all.

SUMMARY OF THE INVENTION

An object of the invention is to provide an adjustable child shoe which contains a plurality of fastening elements in order to adjust the length of the child shoe.

Another object of the invention is to provide an adjustable child shoe which contains an adjustable pad with a foldable extending pad in order to spread the pads smoothly.

Another object of the invention is to provide an adjustable child shoe which contains a grip plate to avoid sliding.

Yet another object of the invention is to provide an adjustable child shoe which can be adjusted to a predetermined size so that the user can feel comfortable for a longer period.

Accordingly, an adjustable child shoe comprises heel, a toecap and an insole. The heel which has a position guiding groove in a middle portion of the heel, an instep on an inner surface of the heel, a plurality of positioning protrusions disposed on the instep, and a plurality of fastening elements. The toecap which has two flaps, an outsole at bottom, an adjustable pad therein and a foldable extending pad at a rear portion of the adjustable pad. A plurality of positioning holes are formed in the adjustable pad. The insole covers an area of the adjustable pad and the foldable extending pad. The positioning protrusions are inserted into the positioning holes.

BRIEF DESCRIPTION OF THE DRAWINGS

FIG. 1A is a bottom view of a toecap of FIG. 1;

FIG. 1B is a bottom view of a heel of FIG. 1;

DETAILED DESCRIPTION OF THE INVENTION

Figure 1:
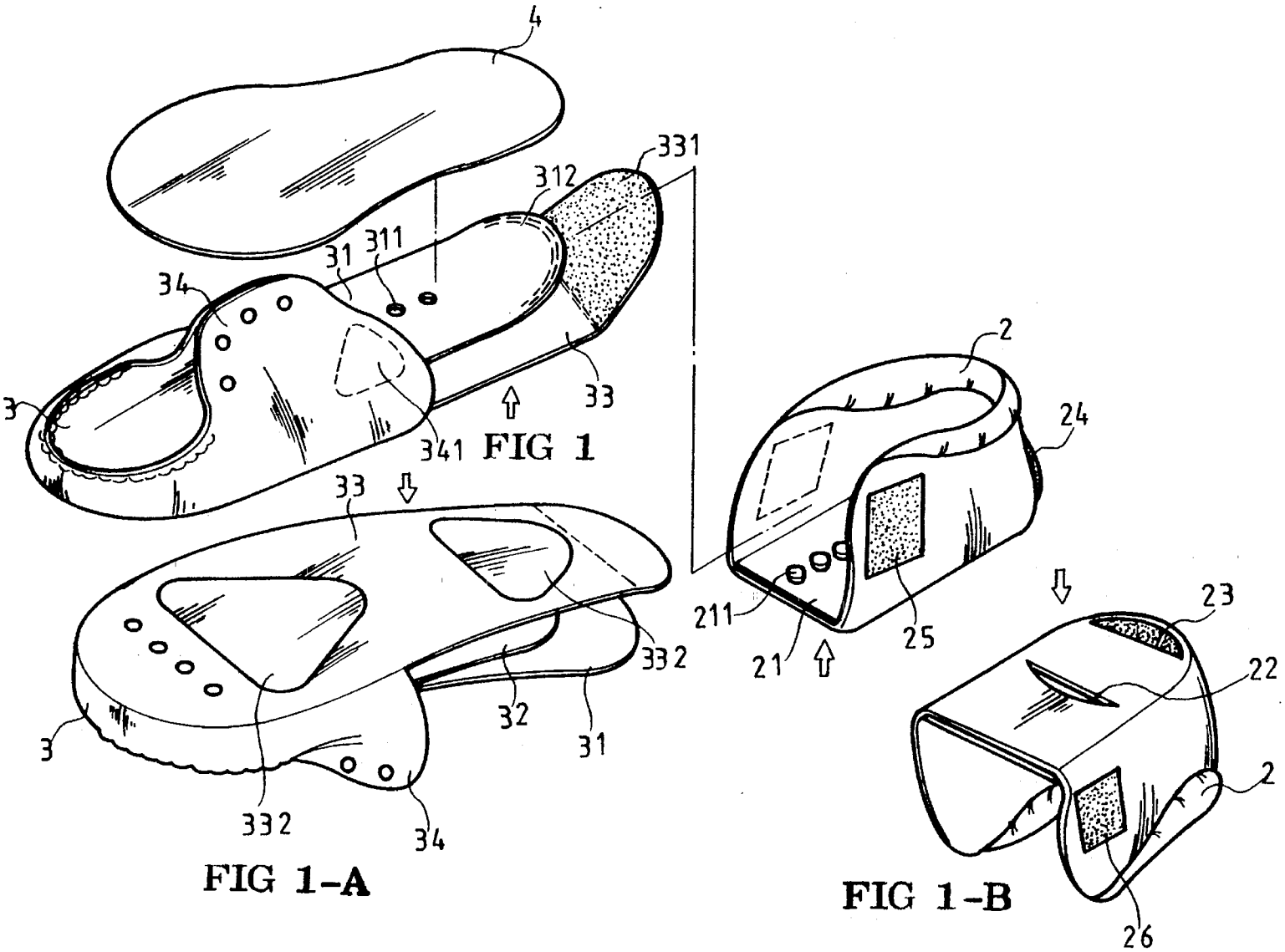
FIG. 1 is a prespective exploded view of a preferred embodiment in accordance with the invention.
Figure 2:
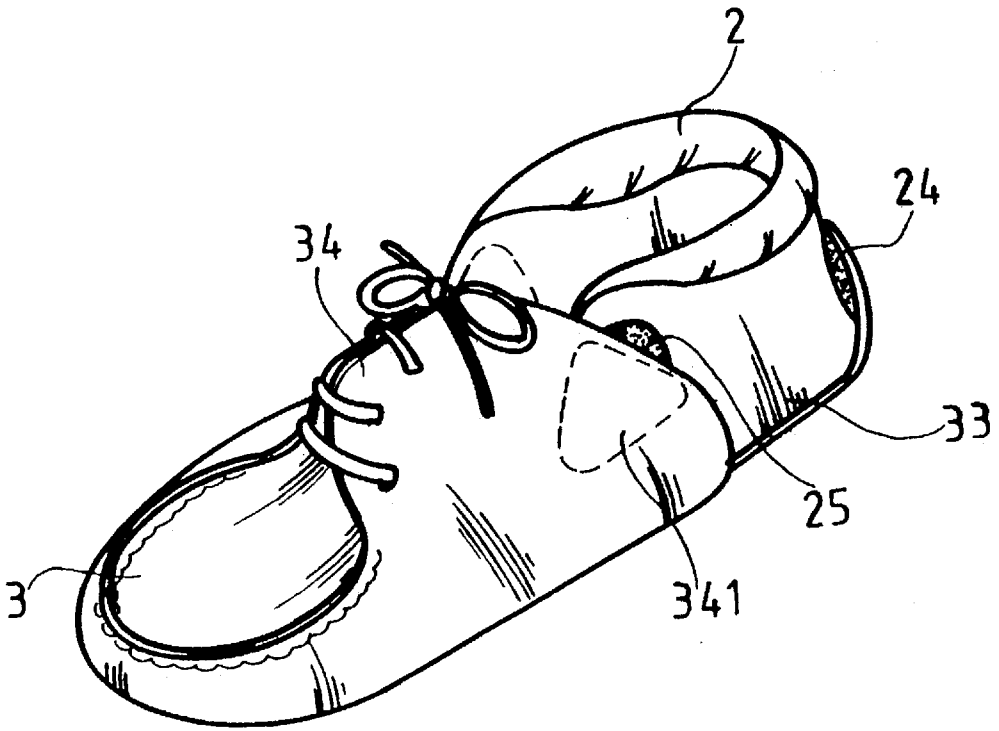
FIG. 2 is a prespective assembly view of FIG. 1.
Figure 4:
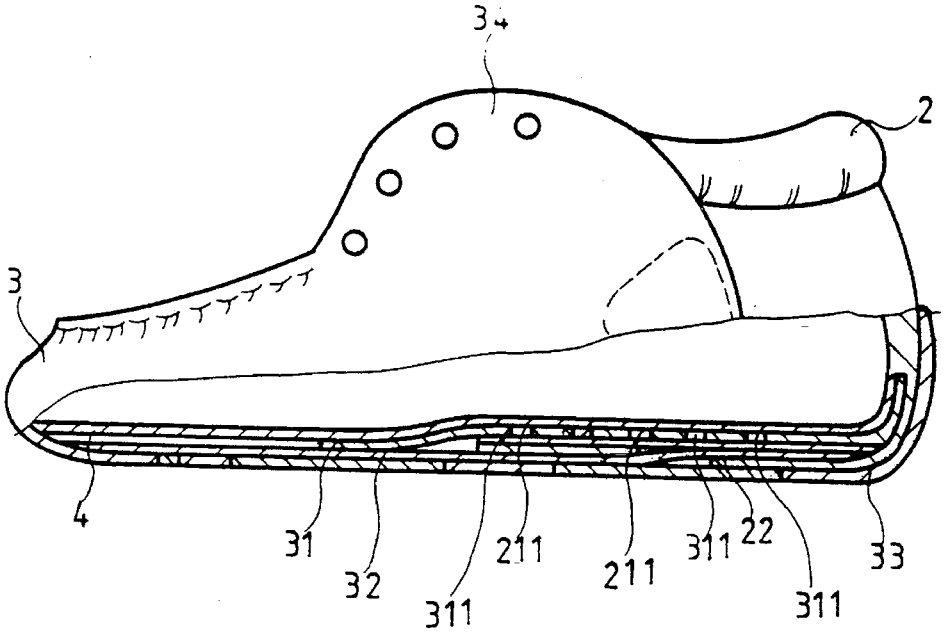
FIG. 4 is a schematic view of FIG. 1 illustrating the largest size of the adjustable child shoe.
Figure 3:
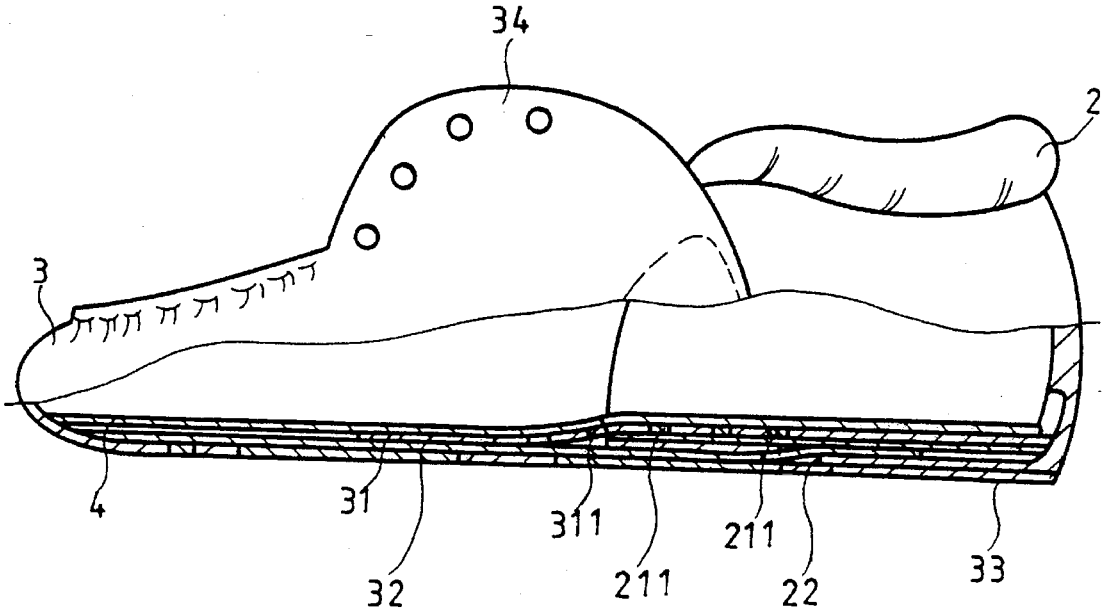
FIG. 3 is a schematic view of FIG. 1 illustrating the smallest size of the adjustable child shoe.

Referring to FIGS. 1, 1A, 1B and 2, an adjustable child shoe has a heel 2, a toecap 3 and an insole 4. The front portion of an instep 21 has a plurality of positioning protrusions 211, and FIGS. 3 and 4 show a receiving groove 213 in the most inner vertical surface 212 of the heel 2. A position guiding groove 22 is formed in the middle portion of the heel 2. The fastening elements such as the first fastening element 23, the second fastening element 24, the third fastening element 25 and the fourth fastening element 26 are disposed on the side and rear portions of -the heel 2. An adjustable pad 31 which has a plurality of positioning holes 311 therein is disposed on the toecap 3. An extending rim 312 which extends from the rear portion of the adjustable pad 31 can be inserted in the receiving groove 213. The inner surface of the flap 34 has the fifth fastening element 341. The rear portion of the outsole 33 has the foldable extending pad 331. The combination of the fastening elements 23, 24, 25, 26 and 341 can fasten the shoe comfortably. The insole 4 is made of soft material, and the size of the insole 4 matches the size of the adjustable pad 31 plus the size of the extending rim 312. The insole 4 can cover the whole surface of the adjustable pad 31 and the extending rim 312. Inserting plate 32 lies between adjustable pad 31 and outsole 33.

Referring to FIGS. 1 to 4, the positioning protrusions 211 are inserted into the corresponding positioning holes 311. The foldable extending pad 312 is inserted into the receiving groove 213. Then the insole 4 is placed in the outsole 33. The combination of the fastening elements 341, 25, 26, 23 and 24 will form a child shoe with the smallest size.

Referring to FIGS. 1 to 4, the insole 4 is removed. The user can detach the heel 2 from the shoe via departing the positioning protrusions 211 from the positioning holes 311. The then heel 2 is moved rearwardly to match the size of the foot. The positioning protusions 211 are inserted into the corresponding positioning holes 311. The foldable extending pad 312 can cover the space between the original size and the final size. Then the insole 4 placed in the shoe. The combination of the fastening elements 23, 24, 25, 26 and 341 will form a child shoe with a larger size.

A plurality of grip plate 332 can be disposed on the bottom of the outsole 33 in order to avoid sliding. The fastening elements can be hook and loop type fasteners.

The invention is not limited to the above embodiment but various modification thereof may be made. It will be understood by those skilled in the art that various changes in form and detail may be made without departing from the spirit and scope of the invention.

What is claimed is:

1. A child shoe comprising:

a heel which has a position guiding groove in a middle portion of said heel, an instep at an inner surface of said heel, a plurality of positioning protrusions disposed on said instep, and a plurality of fastening elements;

a toecap which has two flaps, an outsole at a bottom of said toecap, a pad in said toecap and a foldable extending pad at a rear portion of said pad;

a plurality of positioning holes being formed in said pad;

an insole covering an area of said pad and said foldable extending pad;

whereby said positioning protrusions are inserted into said positioning holes.

2. A child shoe as claimed in claim 1, wherein a plurality of grip plates are disposed on the outer surface of said outsole.

* * * * *